United States Patent [19]
Kozuka et al.
[11] 4,177,366
[45] Dec. 4, 1979

[54] NOISE SUPPRESSION ELECTRODE ARRANGEMENT WITH A ROTOR OF DIELECTRIC MATERIAL

[75] Inventors: Kazuhiro Kozuka; Shin Yamamoto; Mikio Huruhashi, all of Nagoya; Katsutaro Iwaki, Chiryu; Susumu Asari, Kariya, all of Japan

[73] Assignees: Nippondenso Co., Ltd., Kariya; Kabushiki Kaisha Toyota Chuo Kenkyusho, Nagoya, both of Japan

[21] Appl. No.: 867,184

[22] Filed: Jan. 4, 1978

[30] Foreign Application Priority Data

Jan. 19, 1977 [JP] Japan ..... 52-5164

[51] Int. Cl.² ..... H01H 19/00; F02P 7/00; H01H 1/00

[52] U.S. Cl. ..... 200/19 DR; 123/146.5 A; 123/148 P; 200/237; 200/267

[58] Field of Search ..... 200/19 R, 19 DR, 19 DC, 200/262-270, 279, 237; 123/146.5 R, 146.5 A, 148 R, 148 P; 106/73.3, 73.4, 39.7

[56] References Cited

U.S. PATENT DOCUMENTS

| | | | |
|---|---|---|---|
| 2,412,878 | 12/1946 | Fischer | 200/19 DR |
| 2,443,046 | 6/1948 | Mansen | 200/19 DR |
| 2,678,365 | 5/1954 | Bales | 200/19 DR |
| 2,744,180 | 5/1956 | Sullivan | 200/265 |
| 2,772,372 | 11/1956 | Slick | 200/19 DR X |
| 3,846,098 | 11/1974 | Nakashima et al. | 106/39.7 X |
| 3,871,891 | 3/1975 | Schuller et al. | 106/73.4 X |
| 3,932,246 | 1/1976 | Stadler et al. | 106/73.3 X |
| 3,992,230 | 11/1976 | Komiyana et al. | 148/6.3 |
| 4,074,090 | 2/1978 | Hayashi et al. | 123/146.5 A |
| 4,083,727 | 4/1978 | Andrus et al. | 106/39.7 |

*Primary Examiner*—James R. Scott
*Attorney, Agent, or Firm*—Cushman, Darby & Cushman

[57] ABSTRACT

A noise supply suppression electrode arrangement for use in a distributor employed in an ignition system of an internal combustion engine of an automobile or the like. A rotor of the distributor is integrally formed by a dielectric material, such as ceramic, and a rotor electrode is mounted on a turn table of the rotor, the tip of the rotor electrode being located a predetermined distance from the edge of the turn table, so that discharge between the rotor electrode and a counterelectrode occurs through the rotor dielectric material.

5 Claims, 7 Drawing Figures

NOISE SUPPRESSION ELECTRODE ARRANGEMENT WITH A ROTOR OF DIELECTRIC MATERIAL

BACKGROUND OF THE INVENTION

The present invention relates to a noise suppression electrode arrangement which does not disturb broadcast and communication radio waves.

A distributor which is used in an ignition system for an internal combustion engine of an automobile or the like generates a noise when discharge occurs between a rotor electrode and a counterelectrode. Much research and many suggestions have been made to suppress the radiated noise. A recently proposed approach, which is relatively effective, is to join a dielectric material, such as mica or alumina ceramic, at an end of the rotor electrode by a bonding adhesive or rivets. Such an arrangement suppresses the noise by utilizing a creeping discharge along the surface of the dielectric material.

However, in the rotor electrode having the dielectric material joined thereto, the joint must be strong because centrifugal force is applied to the dielectric material mounted at the end of the rotor electrode when the latter is rotated. Further, the dielectric material, as well as the rotor electrode must have high mechanical strength. When the electrode is used in the distributor of an automobile, it is subjected to severe operating conditions because vibration during the running of the automobile is large and the operating temperature varies over a wide range, from −10° C. to 130° C., for example. As a result, problems of loosening or separation of the joint between the rotor electrode and the dielectric material, or the cracking or breakage of the dielectric material at the riveted portion may occur.

SUMMARY OF THE INVENTION

It is an object of the present invention to provide a noise suppression electrode arrangement which overcomes the drawbacks described above and which substantially increases noise suppression. According to the present invention, the arrangement comprises a rotor, formed by a rotor electrode mounted on a turn table, and a counterelectrode spaced from the rotor. The turn table is integrally formed of a dielectric material such as ceramic, and the rotor electrode is located 0.7 to 3 mm from a peripheral edge of the turn table so that a creeping discharge occurs along the surface of the dielectric material during a discharge between the rotor electrode and the counterelectrode.

According to the present invention, since the entire turn table is made from the dielectric material and the rotor electrode is mounted on the turn table, loosening or separation of the joint between the dielectric material and the rotor electrode, or the cracking or breakage of the dielectric material does not occur, as contrasted with the case when the dielectric material is joined to the end of the rotor electrode. Furthermore, since a joint is not required, a troublesome jointing operation is unnecessary and the manufacture of the rotor is facilitated.

It is essential in the present invention that the end surface (discharging surface) of the rotor electrode lies 0.7 to 3 mm from the peripheral edge of the turn table. This assures a creeping discharge along the surface of the dielectric turn table and the resultant effect of substantial noise suppression.

The dielectric material may be selected from the group consisting of ceramic (such as alumina, titania, forsterite and cordierite), cordierite glass ceramic and synthetic resins (such as styrene and epoxy), which permit the creeping discharge when a discharge occurs.

BRIEF DESCRIPTION OF THE DRAWINGS

The above and other objects, features and advantages of the present invention will be apparent from the following description of the preferred embodiments when considered in conjunction with the accompanying drawings, in which:

FIGS. 1(*c*) and 1(*d*) illustrate various modifications of the noise suppression electrode according to the present invention.

DETAILS OF THE INVENTION

Figure 1A:
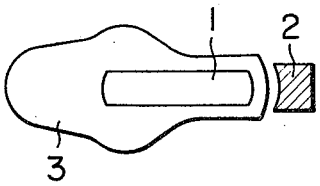
FIGS. 1(*a*) and 1(*b*) are plan and longitudinally sectional views, respectively, of a noise suppression electrode according to the present invention and adapted for use in a distributor.
Figure 1B:
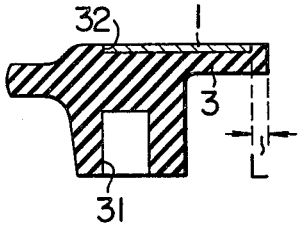
Figure 1C:
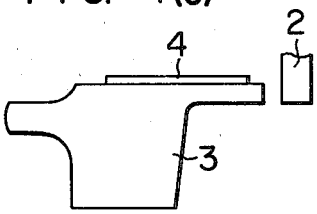
Figure 1D:
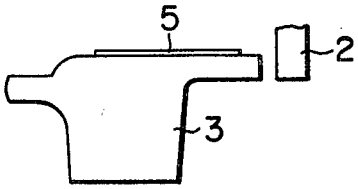

A rotor comprises a thin plate-shaped rotor electrode 1 buried in the top of a turn table 3, as shown in FIGS. 1(*a*) and 1(*b*); a rotor electrode plate 4 bonded on the top of the turn table 3, as shown in FIG. 1(*c*); or a thin film-shaped rotor electrode 5 formed on the top of the turn table 3 by vacuum evaporation, as shown in FIG. 1(*d*). The structure shown in FIGS. 1(*a*) and 1(*b*) exhibits little consumption of the end surface of the rotor electrode resulting from electrical discharge because the electrode is buried within the turn table. In FIGS. 1(*a*), 1(*c*) and 1(*d*), numeral 2 denotes a counterelectrode, and in FIG. 1(*b*) 31 denotes a mounting hole for a rotating shaft which turns the rotor, and 32 denotes a channel in turn table 3 for receiving the rotor electrode.

The rotor electrode lies a predetermined distance from the peripheral edge of the turn table. The predetermined distance extends over that portion of the surface of the turn table required to permit a creeping discharge, as represented by symbol L in FIG. 1(*b*). This distance is measured from the discharging end of the rotor electrode to the terminal end (that end which most closely passes the counterelectrode) of the turn table. This distance is hereinafter referred to as the creeping distance.

It is considered that a creeping discharge can suppress radiated noise because the waveform of the discharge current between the rotor electrode and the counterelectrode is shaped into a waveform having a low peak value and a gradual rising time as a result of the surface resistance of the dielectric material.

It should be understood that the electrode of the present invention can be applied to various types of electrodes and can be employed in the distributor of an automobile.

Specific embodiments of the present invention are explained below.

EMBODIMENT 1

A rotor having the structure as shown in FIGS. 1(*a*) and 1(*b*) was made with the turn table 3 being formed of alumina ceramic. The rotor was mounted in a distributor of an automobile and a radiated electromagnetic field strength was measured.

More particularly, the turn table 3 was prepared by: mixing powders consisting of 96% (by weight, the same as in the following description) of aluminum oxide, 2% of calcium oxide, 1% of talc and 1% of kaolin; molding the mixture in a mold in a conventional manner; and sintering the compacted mass at approximately 1750° C. The sintered compact was formed with the channel 32 on the top thereof for receiving the rotor electrode. The thin plate-shaped rotor electrode 1 made of brass was then fitted in the channel 32 of the turn table 3, and the electrode 1 and turn table 3 were bonded together by a bonding adhesive to complete the rotor as shown in FIGS. 1(*a*) and 1(*b*). The creeping distance L was 1.5 mm.

The rotor thus constructed was mounted on a rotating shaft of the distributor in a conventional manner. The spacing between the end surface of the rotor and the counterelectrode (made of aluminum) was 0.75 mm. Accordingly, the spacing between the discharging end of the rotor electrode 1 and the counterelectrode was 2.25 mm.

The distributor thus constructed was tested to measure a radiated electromagnetic field strength for evaluating the effect of noise suppression. The radiated electromagnetic field strength was measured on a vertical polarization in accordance with the CISPR (Comite International Special des Parturbations Radioelectriques) method which is one of the electromagnetic radiation regulations for the automobile.

Figure 2:
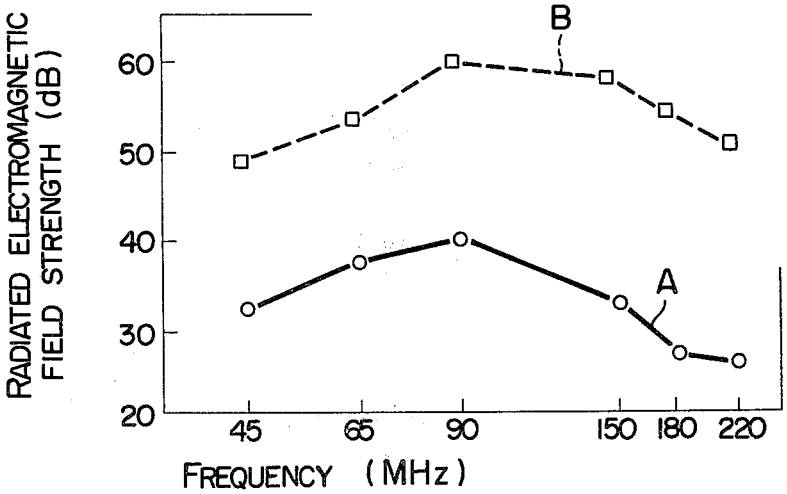
FIGS. 2, 3 and 4 are graphs illustrating the results of measurements taken using the first, second and third embodiments of the present invention.

The result of measurement is shown in FIG. 2 by a solid line A in which an abscissa represents the frequency (MHz) and an ordinate represents the radiated electromagnetic field strength (dB), with 0 dB being 1 $\mu$V/m.

Also shown by a dotted line B in FIG. 2 is the measured result for a conventional rotor, which serves as a comparative data. In the conventional rotor, the rotor electrode 1 was extended toward the counterelectrode 2 so that the rotor electrode 1 projected approximately 6 mm beyond the end surface of the rotor; the rotor was made of phenol resin; and the spacing between the end surface of the rotor electrode and the counterelectrode was 0.75 mm when the rotor was mounted on the distributor.

As seen from FIG. 2, the distributor utilizing an electrode arrangement according to the present invention shows a much lower radiated electromagnetic field strength than that of the conventional distributor and it produces very small noise and thus achieves substantial noise suppression.

Similar measurements were taken for the radiation in a horizontal polarization and similar results were obtained.

EMBODIMENT 2

Figure 3:
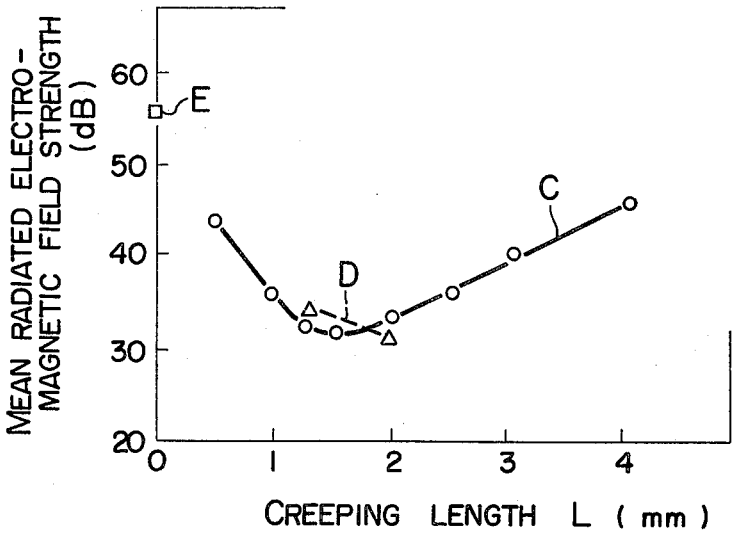

A rotor comprising alumina ceramic turn table similar to that of Example 1 was tested to measure the radiated electromagnetic field strength for various creeping distances L. The results are shown in FIG. 3 by a solid line C in which the abscissa represents creeping distance and the ordinate represents the mean value of the radiated electromagnetic field strength. The mean value was obtained by averaging the radiated electromagnetic field strengths measured at six frequency points, 45, 65, 90, 150, 180 and 220 MHz.

In addition, two rotors were made in accordance with the present invention with the turn table being made of polystyrene resin, which is a dielectric material, the remaining parts being identical to those in the Example 1. One of two rotors had a creeping distance of 1.3 mm and the other had a creeping distance of 2.0 mm.

These rotors were tested in the same manner as that described above. The result is shown in FIG. 3 by a dotted line D.

Also shown in FIG. 3 by a dot E is a mean value, as defined above, for the conventional rotor discussed previously in connection with Embodiment 1.

As seen from FIG. 3, each of the distributors according to the present invention exhibits excellent noise suppression. Particularly when the creeping distance is between 0.7 and 3 mm, the mean value of the radiated electromagnetic field strength is not higher than 40 dB. A similar result was obtained on radiation having a horizontal polarization.

EMBODIMENT 3

Five turn tables were manufactured by different dielectric materials, i.e. alumina ceramics, cordierite ceramics, cordierite glass ceramics, polystyrene resin and epoxy resin, respectively, in the same manner as in Example 1. These turn tables were mounted in the distributors in the same manner as in Embodiment 1 and the radiated electromagnetic field strengths therefor were measured.

Figure 4:
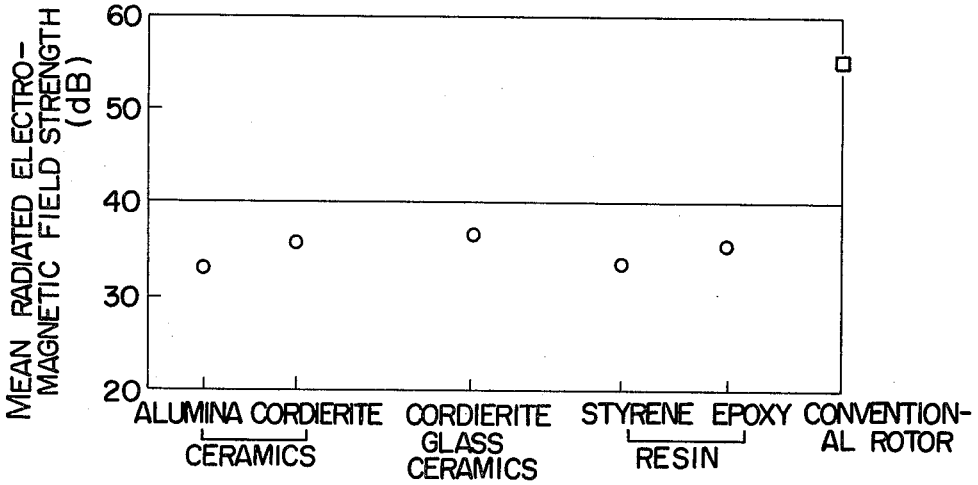

The results are shown in FIG. 4 in which the ordinate represents the mean value of the radiated electromagnetic field strength. The mean value was calculated in the same manner as in Embodiment 2.

Also shown in FIG. 4 for comparison purposes is the mean value for the conventional rotor described in connection with Embodiment 1.

As seen from FIG. 4, each of the distributors according to the present invention exhibits excellent noise suppression. Similar measurements were taken of radiation having a horizontal polarization and similar results were obtained.

The alumina ceramic used was the same as that of Embodiment 1. The cordierite ceramic was prepared by mixing powders consisting of 51% of silicon oxide, 35% of aluminum oxide and 14% of magnesium oxide, and then sintering the mixture. The cordierite glass ceramic was prepared by mixing powders consisting of 62% of silicon oxide, 18% of aluminum oxide, 18% of magnesium oxide and 2% of lithium oxide, melting the mixture at an elevated temperature; molding the mixture; and heating the mold to a temperature to crystallize the same.

We claim:

1. A noise suppression electrode arrangement for suppressing noise associated with an electrical discharge between a movable electrode mounted on a rotor and a stationary counterelectrode positioned in spaced relationship with respect to said rotor, said arrangement being characterized by:

the rotor including a turn table made of dielectric material; and said electrode being mounted on the turn table such that as the electrode passes the counterelectrode during rotation of said rotor, the edge of said electrode nearest to the counterelectrode is located a distance of 0.7 to 3 mm from the edge of the turn table closest to the counterelectrode.

2. A noise suppression electrode arrangement according to claim 1 wherein a channel is formed in the top of said turn table and said electrode is buried in said channel.

3. A noise suppression electrode arrangement according to claim 1 wherein said electrode is bonded to said turn table.

4. A noise suppression electrode arrangement according to claim 1 wherein said electrode is composed of a thin metal film which is formed by vacuum evaporation on said turn table.

5. A noise suppression electrode arrangement according to claim 1 wherein said dielectric material is selected from the group consisting of ceramic such as alumina, titania, forsterite and cordierite, cordierite glass ceramic, and synthetic resin such as styrene and epoxy.

* * * * *